US006036506A

United States Patent [19]

Korsunsky

[11] Patent Number: 6,036,506

[45] Date of Patent: Mar. 14, 2000

[54] RIGHT ANGLE ELECTRICAL CONNECTOR

[75] Inventor: Iosif Korsunsky, Harrisburg, Pa.

[73] Assignee: The Whitaker Corporation, Wilmington, Del.

[21] Appl. No.: 09/040,672

[22] Filed: Mar. 18, 1998

[51] Int. Cl.[7] ..... H01R 1/100

[52] U.S. Cl. ..... 439/79; 439/637

[58] Field of Search ..... 439/74, 79, 80, 439/101, 108, 636, 637, 660

[56] References Cited

U.S. PATENT DOCUMENTS

| | | | |
|---|---|---|---|
| 3,654,592 | 4/1972 | Primorac | 439/636 |
| 4,264,114 | 4/1981 | Chandler | 339/17 |
| 5,114,355 | 5/1992 | Kimmel et al. | 439/101 |
| 5,169,343 | 12/1992 | Andrews | 439/608 |
| 5,184,963 | 2/1993 | Ishikawa | 439/79 |
| 5,203,725 | 4/1993 | Brunker et al. | 439/636 |
| 5,219,295 | 6/1993 | Niwa et al. | 439/79 |
| 5,507,655 | 4/1996 | Goerlich | 439/108 |
| 5,533,901 | 7/1996 | Hunt et al. | 439/79 |
| 5,636,999 | 6/1997 | Hirai et al. | 439/79 |
| 5,647,749 | 7/1997 | Atoh et al. | 439/79 |
| 5,688,130 | 11/1997 | Huang | 439/79 |

*Primary Examiner*—Michael L. Gellner
*Assistant Examiner*—Briggitte R. Hammond

[57] ABSTRACT

An electrical connector 10 is provided for completing a right angle electrical interface between a pair of circuit boards. The connector 10 features an insulative housing 20 having an upright section 30 and a board receiving section 28. The board receiving section has open top and bottom outer surfaces 29, 27 for allowing insertion of contacts 50, 52 into contact receiving passages 34, 32. A ground plane 60 is disposed over the top set of contacts 50 and is profiled to engage selected ones of the contacts 50 in the upright section of the passage 34.

18 Claims, 8 Drawing Sheets

RIGHT ANGLE ELECTRICAL CONNECTOR

FIELD OF THE INVENTION

This invention is related to electrical connectors and more particularly to a right angle circuit board receiving connector.

BACKGROUND OF THE INVENTION

In computer and other applications, it is commonly necessary to form a plurality of electrical connections between two printed circuit boards. These connections can be achieved through an interface between an edge of one printed circuit board and an electrical connector mounted on the other printed circuit board. Each application requires a certain orientation of the boards relative to each other. For example, the application may require that the boards be positioned perpendicular to each other. Other applications may require the boards to be positioned parallel to each other. One way to achieve a parallel interface is to mount a right angle electrical connector on a printed circuit board which receives the edge of the other board.

One such example is shown in U.S. Pat. No. 5,219, 295. That patent teaches a high density electrical connector having a housing with contacts arranged in rows to engage a printed circuit board. The housing supports the contacts in a right angle orientation. Another example of such a right angle connection is shown in U.S. Pat. No. 5, 533, 901. That patent teaches an electrical connector having a housing which supports multiple electrical contacts each having terminals which are profiled to be mounted to a printed circuit board at a right angle.

A problem exists with both of these designs in that an alignment member is required in order to properly position the terminals or pins for mounting to the circuit board. This increases the complexity of the electrical connector and increases the manufacturing steps required to assemble such a connector. For example, each of these designs requires that the contacts be inserted into the housing from a rear end. Then, the contacts are typically bent at a right angle and the alignment member is installed to properly position each of the terminals for termination to and mounting on the printed circuit board.

SUMMARY

It is therefore an object of the present invention to address the above mentioned problems by providing a simplified electrical connector housing and contact arrangement which allows for proper alignment of the contact terminals and a simplified assembly process.

This and other objects have been achieved by providing an electrical connector having a housing being profiled to have an upright section and a board receiving section. The board receiving section and upright section are oriented at an angle to each other. A plurality of contact receiving openings extend from a mating end in the board receiving portion to a mounting face on the upright section. The contact receiving openings are open to the a board receiving opening which extends inward from the mating end and also open to an outer surface of the board receiving section.

BRIEF DESCRIPTION OF THE DRAWINGS

The invention will now be described by way of example with reference to be accompanying figures of which.

DETAILED DESCRIPTION OF THE EMBODIMENT

Figure 1:
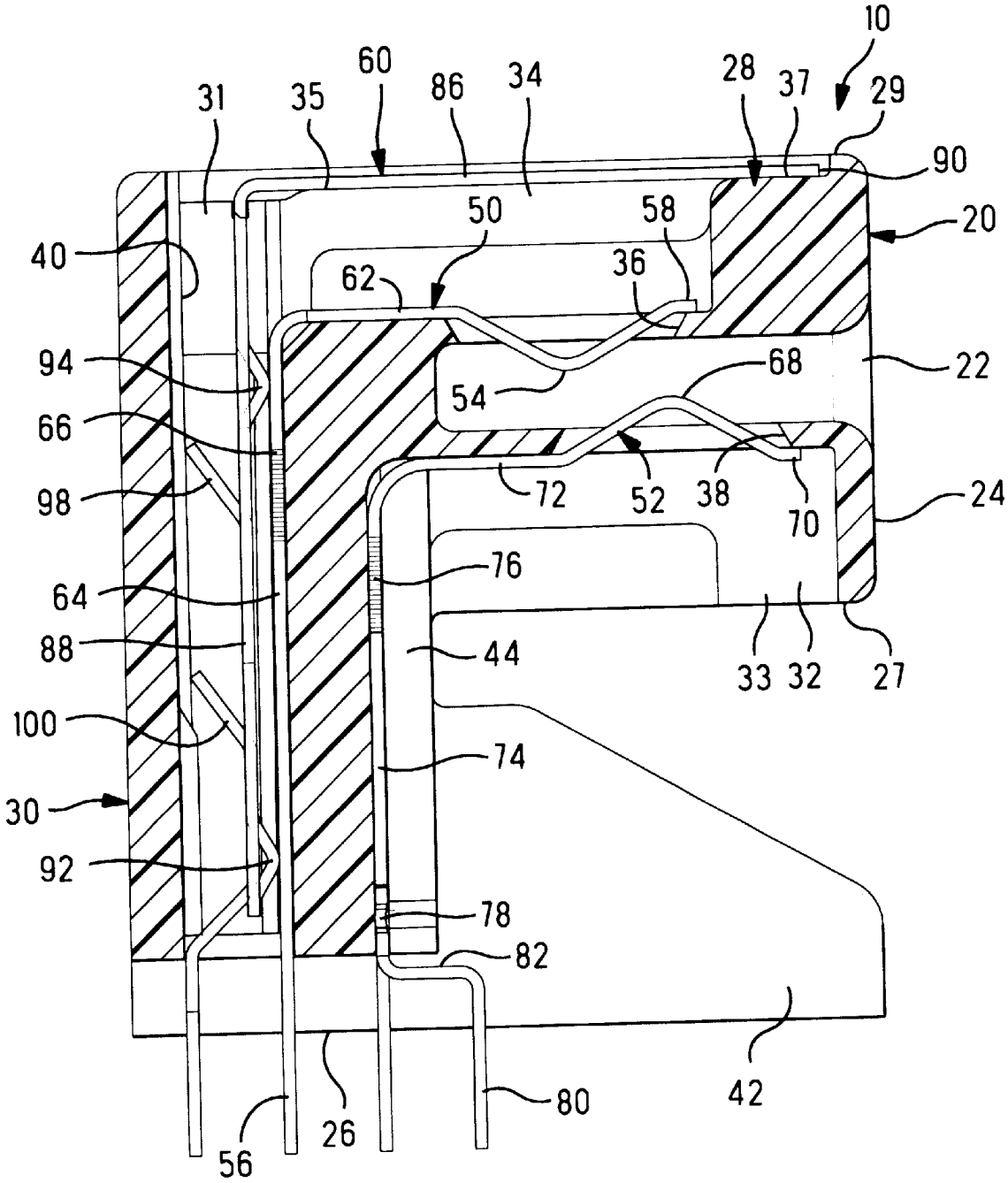
FIG. 1 shows a cross sectional view of the electrical connector according to the present invention.

The invention will first be described generally with reference to FIG. 1. This figure shows a cross sectional view of the electrical connector 10 according to the present invention. The electrical connector 10 features an insulative housing 20 having an upright section 30 and a board receiving section 28 which extends substantially perpendicular from the upright section 30. The board receiving section 28 has a mating end 24 and a board receiving opening 22 which extends inward from the mating end 24 and across substantially the entire length of the board receiving section 28. A set of top contact receiving passages 34 extends from the board receiving section 28 through the upright section 30. Similarly, a set of bottom contact receiving passages 32 extend from the board receiving section 28 through the upright section 30. A first set of top contacts 50 are disposed in the top contact receiving passages 34. Similarly, a set of bottom contacts 52 are disposed in the bottom contact receiving passages 32. A ground plane 60 is disposed over the top contacts 50 and inside the upright portion of the contact receiving passage 34.

Figure 2:
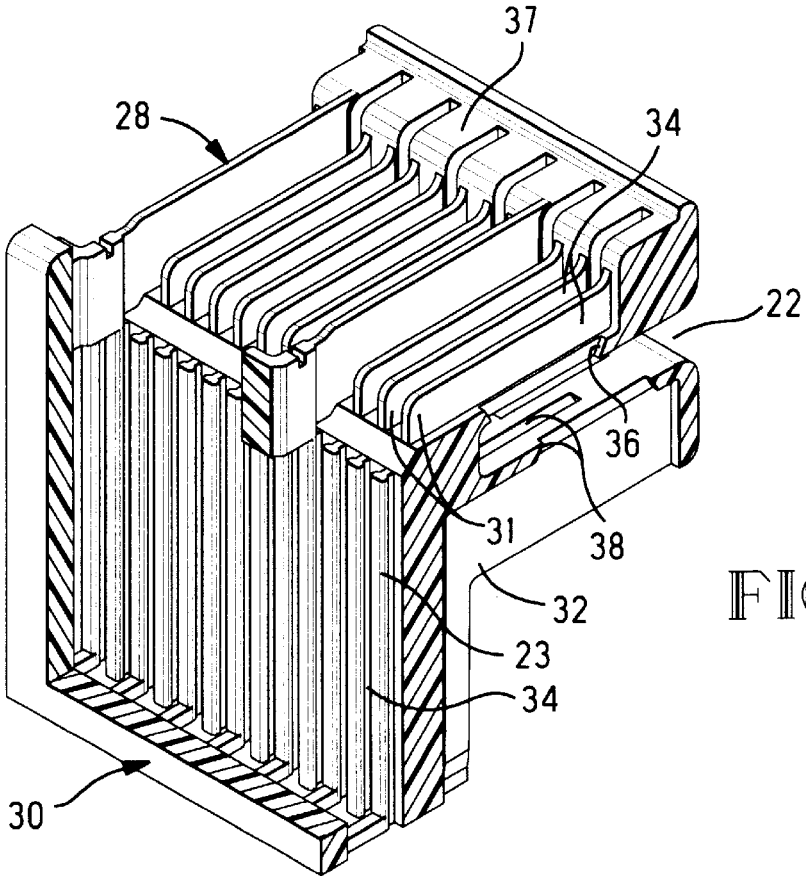
FIG. 2 shows a three dimensional partial rear view of the housing used in the connector of FIG. 1.
Figure 3:
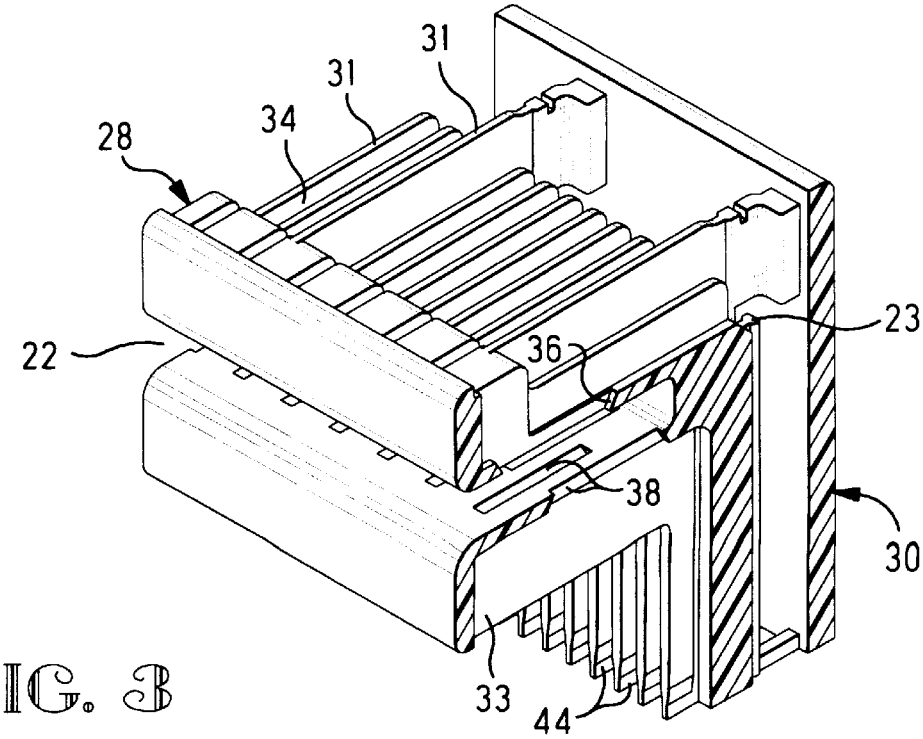
FIG. 3 shows a three dimensional partial front view of the housing used in the connector of FIG. 1.
Figure 4:
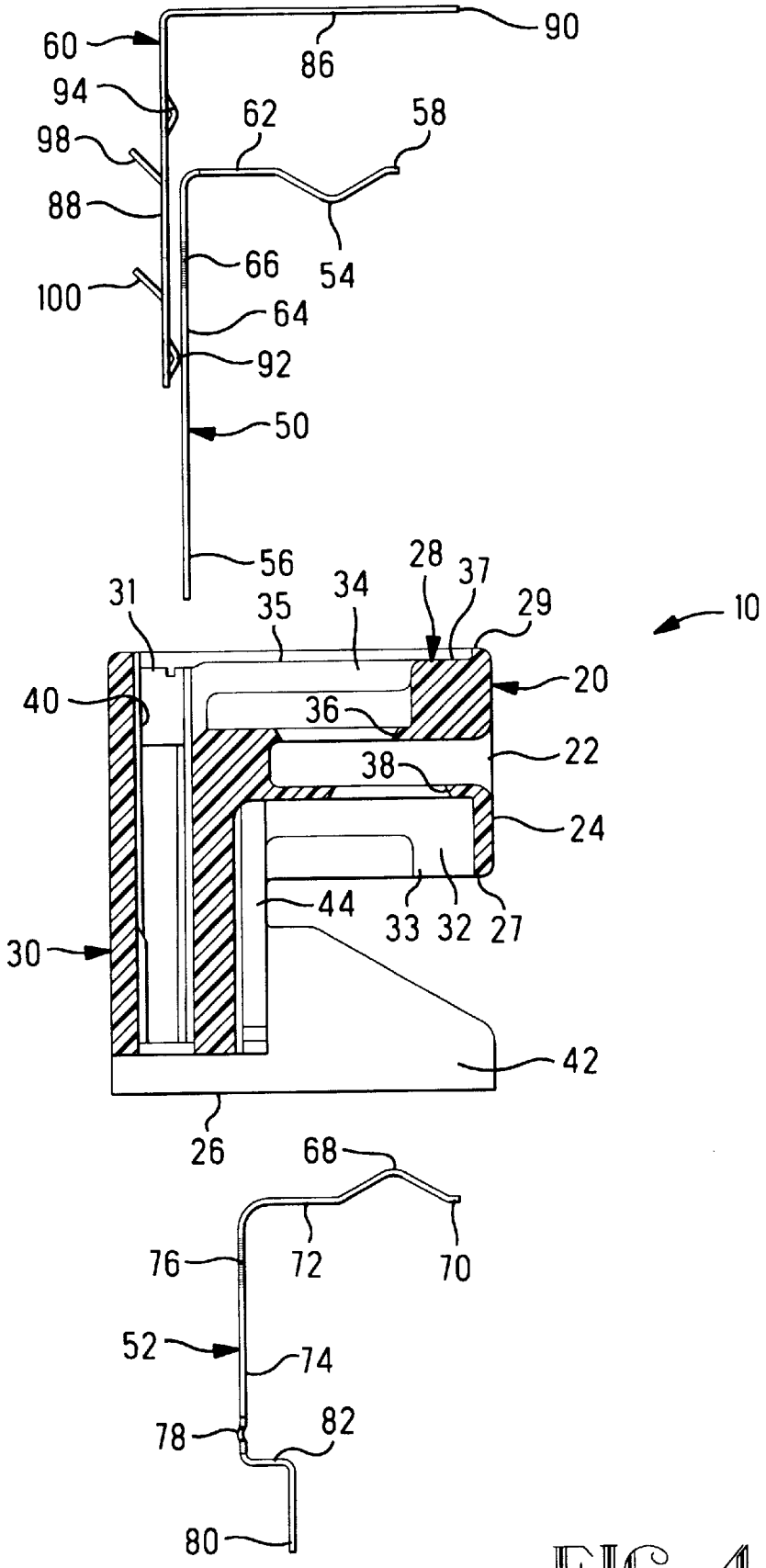
FIG. 4 shows an exploded cross sectional view of the electrical connector of FIG. 1.
Figure 5:
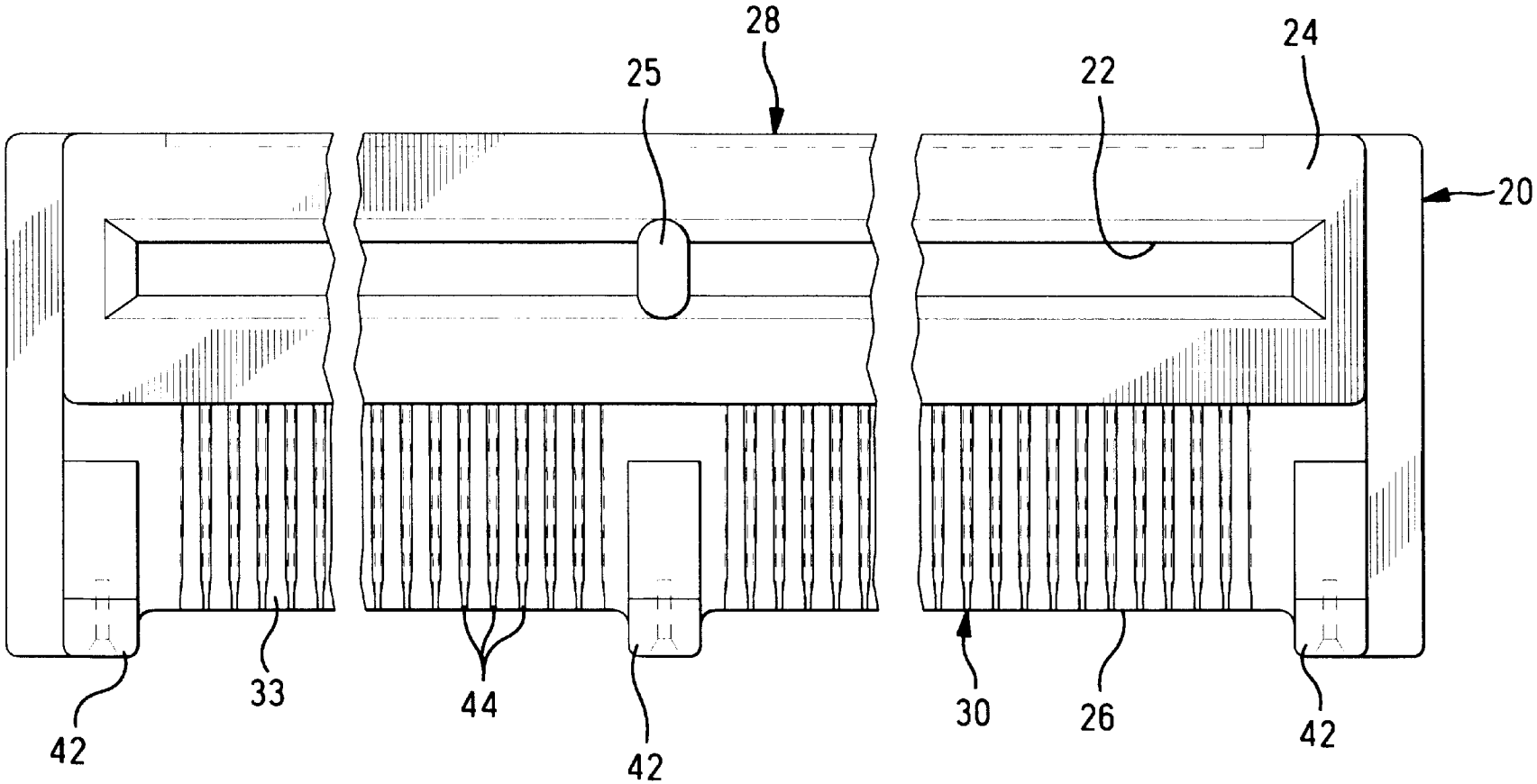
FIG. 5 shows a front side view of the electrical connector of FIG. 1.
Figure 6:
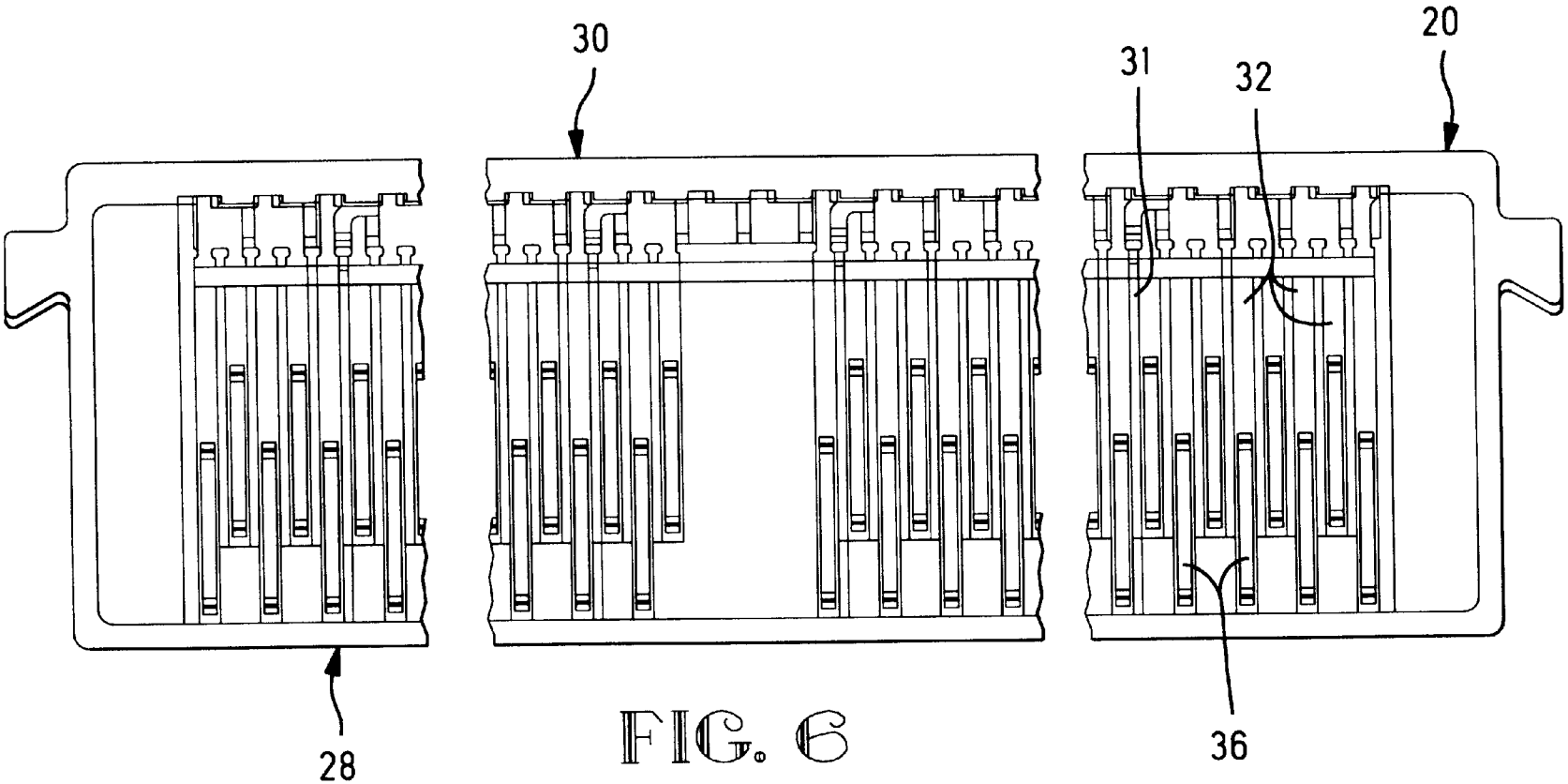
FIG. 6 shows a top side view of the electrical connector of FIG. 2.
Figure 7:
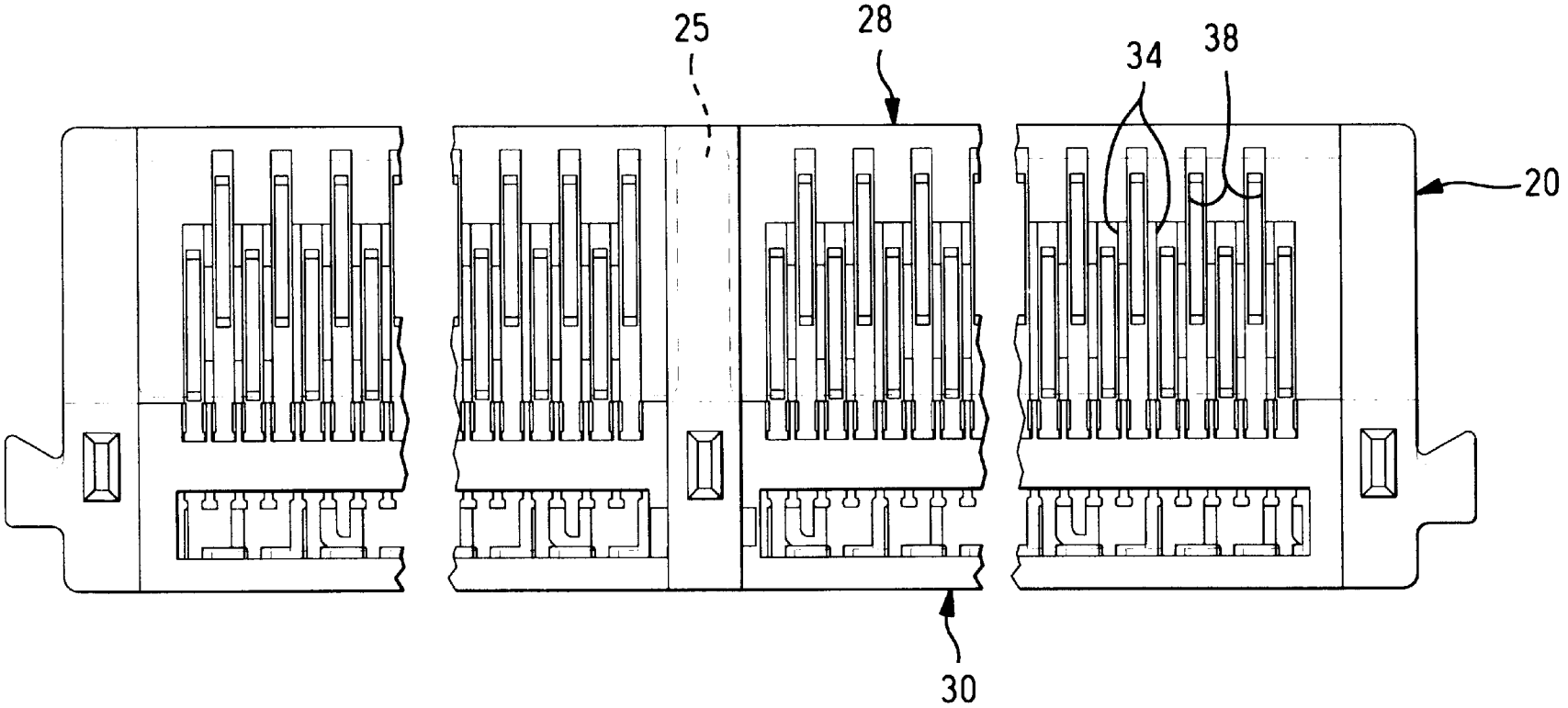
FIG. 7 shows a bottom side view of the electrical connector of FIG. 2.
Figure 8:
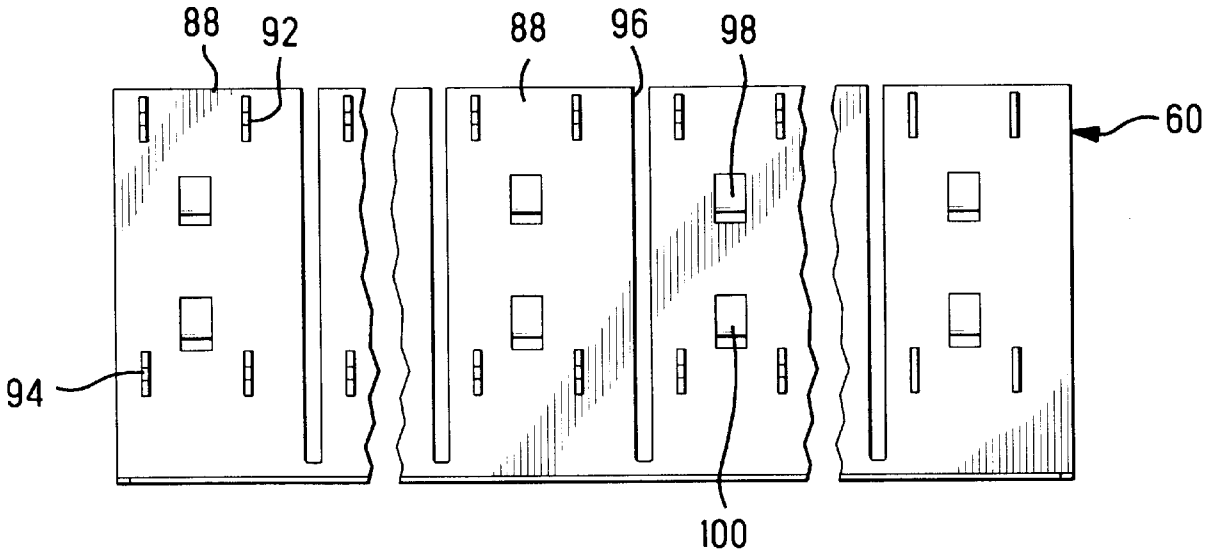
FIG. 8 shows a left side view of the ground plane used in the connector of FIG. 1.
Figure 9:
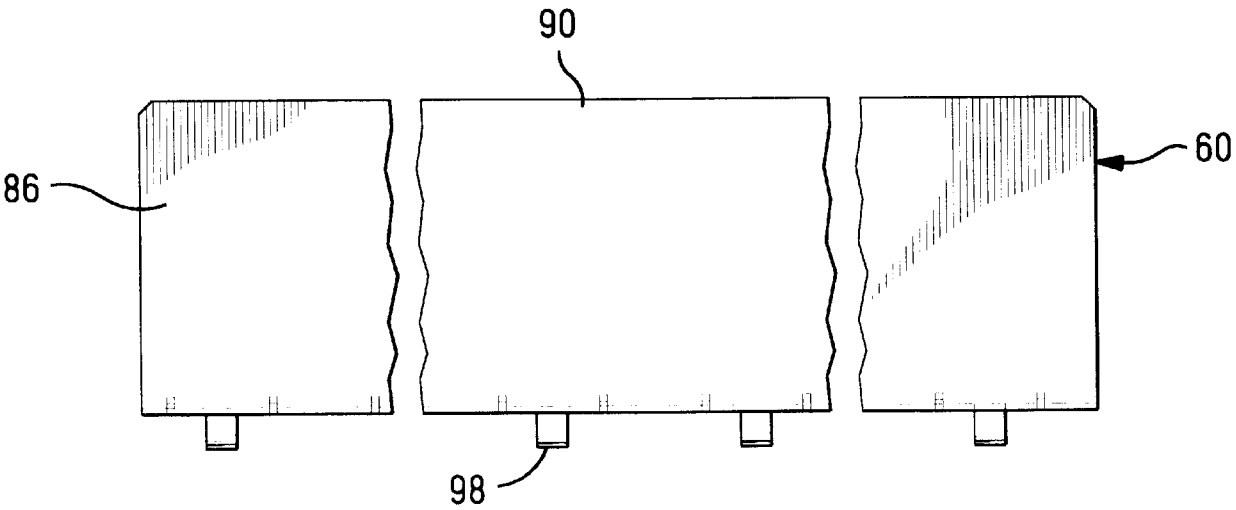
FIG. 9 shows a top side view of the ground plane of FIG. 5.

Each of the major components will now be described in greater detail. First, the housing 20 will be described in greater detail with reference to FIGS. 2–7. FIGS. 2 and 3 show partial three dimensional views and FIGS. 5–7 show side, top and bottom views. The insulative housing 20 has a board receiving opening 22 which extends along a board receiving end 24. An optional keying member 25 (FIGS. 5–7) is disposed inside the board receiving opening 22 and extends inward from the board receiving end 24. A plurality of stand offs 42 are disposed at side ends of the insulative housing 20 and along the length opposite the keying member 25. The upright section 30 contains an upright portion 44 of each bottom contact passage 32. The upright portions 44 of these passages 32 extend from the board mounting face 26 to the board receiving section 28.

Turning now to FIG. 7, the insulative housing 20 is shown as viewed from the bottom side or board mounting face 26. It can be seen that each of the bottom contact receiving passages 32 are profiled to have openings 38 which are staggered with respect to each other across the housing length. For example, from the left side, the first opening 38 is positioned toward the upright section 30 and the next opening 38 is positioned toward the mating end 24 of the board receiving section 28. The contacts 50, 52 are positioned in this staggered arrangement across the entire housing 20. Similarly, the top set of contact receiving passages 34 are staggered back and forth from the upright section 30 to the mating end 24 of the board receiving section 28. It should also be noted here that the top and bottom set of contact receiving passages 34, 32 and openings 36, 38 are staggered opposite to each other. Therefore, as viewed in the cross sectional view of FIG. 4, it can be seen that the top contact receiving passage opening 36 is positioned toward the upright section 30 and the bottom contact receiving passage opening 38 is positioned opposite that of the top contact receiving passage opening 36.

Each of the top and bottom contact receiving passages 34, 32 are open to the board receiving opening 22 through the openings 36, 38 described above. The top contact receiving passages 34 are also open to a top outer surface 29 of the board receiving section 28. The top contact receiving passages 34 also extend into the upright section 30 and has a back wall 40. As best seen in FIG. 2 the upright portions of each top contact receiving passage 34 is separated by a T-shaped wall 23. The T-shaped wall 23 serves to capture an upright portion 64 as shown in FIG. 4 of the contact 50 as will be further described below. Similarly, each of the bottom contact receiving passages 32 opens into the board receiving opening 22 through opening 38. These contact receiving passages 32 are also open to the bottom outer surface 27 of the board receiving section 28. The bottom contact receiving passageways 32 also extend into the upright section 30.

A ledge 37 is disposed along the top surface 29. A plurality of walls 31 as shown in FIG. 4 are disposed each between selected adjacent contact receiving passages 34. These walls 31 extend from the transition between the upright and board receiving sections 30 and 28 through the board receiving section 28. Selected ones of the walls 31, are profiled to extend to the plane of the ledges 37. Similarly, a plurality of walls 33 and 44 as shown in FIG. 3 are disposed between each of the contact receiving passages 32 and 34, respectively.

The contacts 50, 52 will now be described in greater detail with reference to FIG. 1. First, The top set of contacts 50 will be described. A board engaging portion 54 extends from a free end 58 and is formed in a top arm 62. An upright arm portion 64 extends from the top arm 62 at a right angle. A terminal portion 56 extends from the upright arm 64 at a free end. Barbs 66 extend from side edges of the upright portion 64. Similarly, the bottom set of contacts 52 feature a board engaging portion 68 extending from a free end 70 along a top arm 72. An upright arm portion 74 extends from the top arm 72 at a right angle. Barbs 76 extend from side edges of the upright portion 74. A dimple 78 is formed in the upright portion in order to urge it against a wall of the passage 32 for properly positioning the terminal portion 80 which extends from the upright section 74. It should be noted here that a jog 82 is formed in the upright portion 74. A similar jog may be formed in the top set of contacts 50 depending on its position in the housing as was described above.

Figure 10:
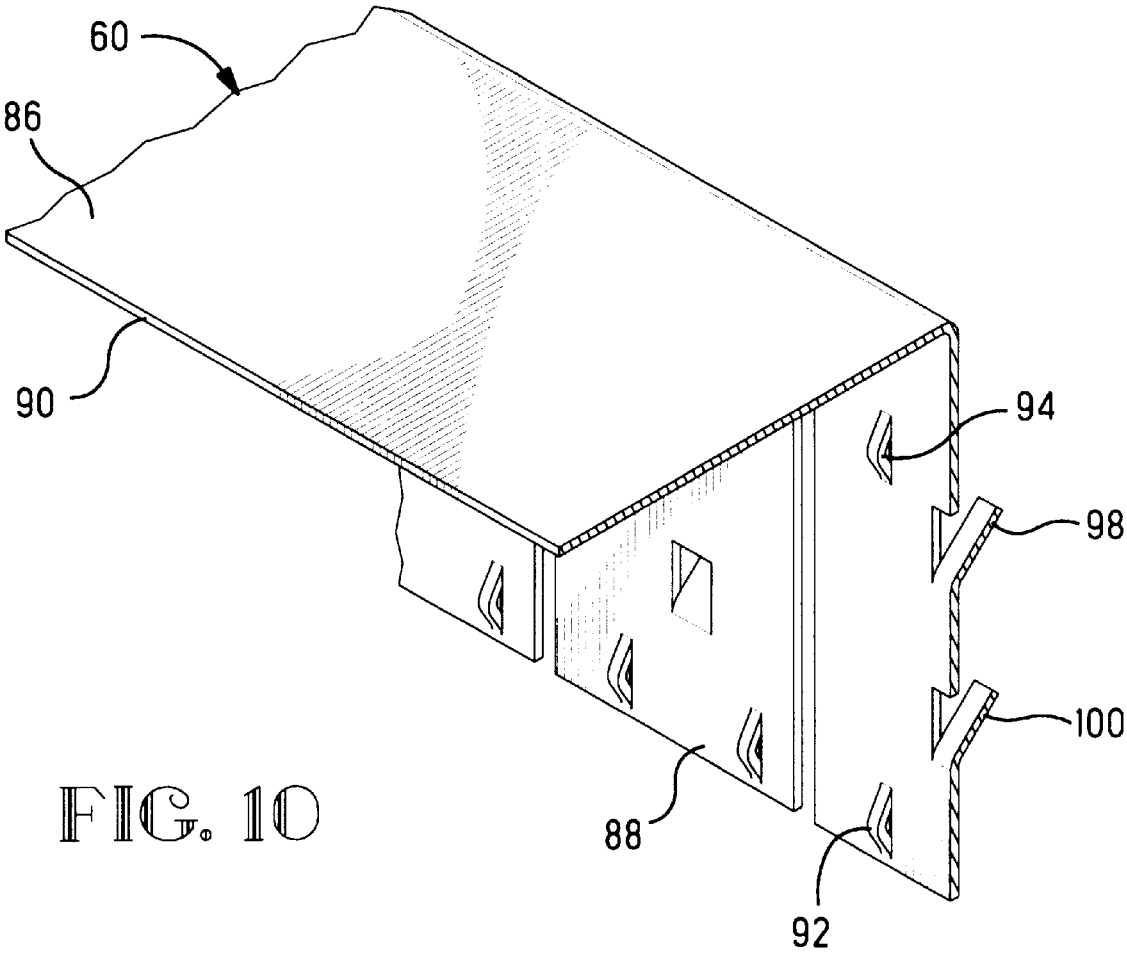
FIG. 10 shows a partial three dimensional view of the ground plane of FIGS. 8 and 9.

The ground plane 60 will now be described in greater detail with reference to FIG. 10. The ground plane 60 consists of a top surface 86 which is generally planar and a plurality of fingers 80 which extend from the top surface 86 at approximately a right angle. The top surface 86 has a free end 90. Each finger 88 will now be described in greater detail with reference to FIGS. 1 and 5. Contacts 92, 94 are preferably drawn from each finger 88. It should be understood that these contacts 92, 94 may be simply lanced or alternatively may be drawn as shown. These contacts 92, 94 are preferably drawn from the fingers 88 in a direction toward the free end 90. Therefore a contact point is formed between a pair of ends which are attached to the finger 88. A series of securing lances 98, 100 are formed from each finger 88. These securing lances 98, 100 are formed in a direction opposite to the contacts 92, 94. A slot 96 is formed between each set of adjacent fingers 88. The ground plane 60 is formed of a conductive material, preferably low carbon steel. Alternatively, any conductive material such as brass could be used to form the ground plane 60.

Assembly of the major components will now be described in greater detail. First, contacts 50 are insertable into the contact receiving passages 34 such that the upright sections 64 fit between the T-shaped walls 23 and barbs 66 engage sides of the T-shaped walls 23. Next, the bottom row of contacts 52 are similarly inserted into the contact receiving passages 32 such that barbs 76 engage side walls of each passage 32 to secure the contacts therein. Once the contacts 50, 52 are secured in position, each of the board engaging portions 44, 68 will pass through openings 36, 38 into the board receiving opening 22 and the terminal sections 56, 80 will extend beyond the mounting face 26. Finally, the ground plane 60 is inserted into the top contact receiving passages 34 such that securing lances 98, 100 engage the back wall 40 of the contact receiving passages 34 in the upright section 30. The securing lances 66, 100 serve to urge the finger 88 into engagement with selected contacts 50 at the contacts 94, 92. It should also be noted here referring to FIGS. 1 and 3 that walls 31 of the housing 20 will fit between the fingers and into slots 96. Therefore, each finger 88 is profiled to cover eight contacts 50. Contact points 92, 94 are selected to engage two of the eight covered contacts 50. The free end 90 is secured on the ledge 102 and is positioned over the shoulder 35. It should be understood here that while the ground plane 60 is shown here to function as an electrical commoning member to connect selected contacts 50 to a ground connection on the printed circuit board, it could be used to common other signals as well. For example, it could be utilized to common a plurality of power signals among selected contacts 50 or alternatively, any signal could be commonly applied to the selected contacts 50 through this commoning technique. It should also be understood here that while the invention is embodied here in a right angle electrical connector, these concepts are equally applicable to other angular orientations. For example this invention is applicable to 45 degree and other angular orientations.

An advantage of the present invention is that contacts 50, 52 are loadable into the housing 20 through openings in top and bottom surfaces 29, 27 of the board receiving section 28. This allows for pre stamped and formed contacts to be loaded in a single step. Also, an additional advantage of the present invention is that the ground plane 60 is easily insertable and secured into the housing and serves as a cover to close the open top surface 29. This reduces the overall connector height.

I claim:

1. An electrical connector comprising: an insulating housing having a board mounting face, the housing having a board receiving opening in a board receiving section of the housing, first contacts and second contacts being conductive and extending at the board mounting face, the board receiving section of the housing having first passages that are open along a top surface of the board receiving section, the board receiving section of the housing having second passages that are open along a bottom surface of the board receiving section of the housing, the first passages and the second passages extending into the board receiving opening from the top surface and the bottom surface, respectively, whereby, the first contacts are received in the first passages and into the board receiving opening from the top surface, and the second contacts are received in the second passages and into the board receiving opening from the bottom surface.

2. An electrical connector as recited in claim 1 wherein, the board mounting face is on a further section of the housing, and the first and second contacts in the first and second passages extend along the further section of the housing.

3. An electrical connector as recited in claim 1 wherein, the board mounting face is on a further section of the housing, the first contacts in the first passages extend along the further section of the housing, the second contacts and the second passages extend along an open side of the further section of the housing, and the second contacts are received in the second passages from the open side.

4. An electrical connector as recited in claim 1 wherein, the board mounting face is on a further section of the housing, the first passages extend from the top surface to an inside of the further section of the housing, and the first contacts are received into the inside of the further section from the top surface.

5. An electrical connector as recited in claim 1 wherein, a ground plane covers the top surface and engages selectively with the first contacts.

6. An electrical connector as recited in claim 1 wherein, a ground plane covers the top surface, fingers on the ground plane engage the housing and urge the ground plane toward the first contacts, and selective ones of the first contacts engage the ground plane.

7. An electrical connector as recited in claim 1 wherein, the board mounting face is on a further section of the housing, a ground plane covers the top surface, and the ground plane and the first contacts extend inside the further section of the housing.

8. An electrical connector as recited in claim 1 wherein, the board mounting face is on a further section of the housing, the first passages extend from the top surface and inside the further section of the housing, the first contacts are received inside the further section of the housing from the top surface, and the ground plane covers the top surface.

9. An electrical connector as recited in claim 1 wherein, the board mounting face is on a further section of the housing, the first passages extend from the top surface and extend further at an angle inside the further section of the housing, the first contacts are received in the first passages from the top surface, the ground plane covers the top surface and extends at an angle to extend inside the further section of the housing, and selected ones of the first contacts engage the ground plane.

10. An electrical connector comprising: a housing having a board receiving section having a first outer surface and a second outer surface, a board receiving opening extending between the first outer surface and the second outer surface, first contacts and second contacts extending into the board receiving opening, first passages opening into the first outer surface of the board receiving section and opening into the board receiving opening, and second passages opening into the second outer surface and opening into the board receiving opening, whereby, the first contacts are received in the first passages and into the board receiving opening from the first outer surface, and the second contacts are received in the second passages and into the board receiving opening from the second outer surface.

11. An electrical connector as recited in claim 10 wherein, the housing has a board mounting face on a further section of the housing, and the first and second contacts in the first and second passages extend along the further section of the housing to the board mounting face.

12. An electrical connector as recited in claim 10 wherein, the board receiving section is connected to a further section of the housing, the first contacts in the first passages extend along the further section of the housing, the second contacts and the second passages extend along an open side of the further section of the housing, and the second contacts are received in the second passages from the open side.

13. An electrical connector as recited in claim 10 wherein, the board receiving section is connected to a further section of the housing, the first passages extend from the first surface to an inside of the further section of the housing, and the first contacts are received into the inside of the further section from the first surface.

14. An electrical connector as recited in claim 10 wherein, a ground plane covers the first outer surface and engages selectively with the first contacts.

15. An electrical connector as recited in claim 10 wherein, a ground plane covers the first outer surface, fingers on the ground plane engage the housing and urge the ground plane toward the first contacts, and selective ones of the first contacts engage the ground plane.

16. An electrical connector as recited in claim 10 wherein, the board receiving section is connected to a further section of the housing, a ground plane covers the first outer surface, and the ground plane and the first contacts extend inside the further section of the housing.

17. An electrical connector as recited in claim 10 wherein, the board receiving section is connected to a further section of the housing, the first passages extend from the top surface and inside the further section of the housing, the first contacts are received inside the further section of the housing from the first surface, and the ground plane covers the first outer surface.

18. An electrical connector as recited in claim 10 wherein, the board receiving section is connected to a further section of the housing, the first passages extend from the first surface and extend further at an angle inside the further section of the housing, the first contacts are received in the first passages from the first surface, the ground plane covers the first outer surface and extends at an angle to extend inside the further section of the housing, and selected ones of the first contacts engage the ground plane.

* * * * *